US008289190B2

(12) United States Patent
Lim et al.

(10) Patent No.: US 8,289,190 B2
(45) Date of Patent: Oct. 16, 2012

(54) ADAPTIVE COMMUNICATION METHOD AND SENSOR NODE FOR PERFORMING THE METHOD

(75) Inventors: Jae Han Lim, Daejeon (KR); Jungsook Kim, Daejeon (KR); Kyeong Tae Kim, Chuncheon-si (KR); Byung Tae Jang, Daejeon (KR); Kyung Bok Sung, Daejeon (KR); Jaejun Yoo, Daejeon (KR); Do Hyun Kim, Daejeon (KR); Jeong Dan Choi, Daejeon (KR); Jeong Ah Jang, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 502 days.

(21) Appl. No.: 12/630,481

(22) Filed: Dec. 3, 2009

(65) Prior Publication Data

US 2010/0141478 A1 Jun. 10, 2010

(30) Foreign Application Priority Data

Dec. 4, 2008 (KR) ..... 10-2008-0122728

(51) Int. Cl.
*G08G 1/01* (2006.01)

(52) U.S. Cl. ..... 340/938; 340/933

(58) Field of Classification Search ..... 340/933, 340/938
See application file for complete search history.

(56) References Cited

U.S. PATENT DOCUMENTS

| | | | | |
|---|---|---|---|---|
| 6,401,027 | B1 * | 6/2002 | Xu et al. | 701/117 |
| 6,639,520 | B2 * | 10/2003 | Nomura et al. | 340/905 |
| 7,184,413 | B2 | 2/2007 | Beyer et al. | |
| 2008/0086260 | A1 | 4/2008 | Lee et al. | |

FOREIGN PATENT DOCUMENTS

| | | |
|---|---|---|
| KR | 10-2008-0012475 | 2/2008 |
| WO | WO 03/079611 | 9/2003 |
| WO | WO 2007/025139 | 3/2007 |

* cited by examiner

*Primary Examiner* — Travis Hunnings
(74) *Attorney, Agent, or Firm* — Staas & Halsey LLP

(57) ABSTRACT

Provided are an adaptive communication method and a sensor node for performing the same. The sensor node adaptively selects transmitted signal output strength and a wakeup zone of transmitted data based on a received signal strength indication of a control packet received from a sink node and existence of an obstacle acquired through a sensor, and transmits data based on the adaptive selection. Also, during an operation as a receive mode, the sensor node wakes up and determines whether to receive the data from the transmit node based on wakeup zone configuration information per sensor node received from the sink node and a wakeup zone selected by a sensor node currently operable as a transmit node.

14 Claims, 3 Drawing Sheets

ADAPTIVE COMMUNICATION METHOD AND SENSOR NODE FOR PERFORMING THE METHOD

CROSS-REFERENCE TO RELATED APPLICATION

This application claims priority to and the benefit of Korean Patent Application No. 10-2008-0122728 filed in the Korean Intellectual Property Office on Dec. 4, 2008, the entire contents of which are incorporated herein by reference.

BACKGROUND OF THE INVENTION (a) Field of the Invention

The present invention relates to an adaptive communication method and a sensor node for performing the same method. Particularly, the present invention relates to an adaptive communication method for a road environment and a sensor node for performing the same.

(b) Description of the Related Art

In general, a wireless sensor network is configured by several sink nodes and a plurality of sensor nodes. Here, the sink node represents a node where data collected through the sensor nodes are gathered, and it manages the wireless sensor network with sufficient power. Also, the sensor node collects environment monitoring information, vehicle sensing information, and pollution information through an installed sensor, and transmits them. The sensor node must be inexpensive since many sensor nodes are installed in a wireless sensor network. Accordingly, low-performance batteries, memories, and processors are used for the sensor nodes. Hence, the wireless sensor network must support low power consumption, and various method for supporting the low power consumption in the wireless sensor network have been proposed.

The sensor medium access control (SMAC) protocol is the representative low power consumption transmission method of the sensor network, and each node synchronizes the operation time with neighboring nodes. Further, each node repeatedly wakes and sleeps periodically in synchronization with the operation time.

The IEEE 802.15.4 protocol is the representative communication protocol for the wireless personal area network (WPAN), and it is generally used as the communication method for the wireless sensor network. In detail, time intervals, which are called super frames, with a predetermined length are iterated, and each super frame is configured with a beacon transmission interval, an active interval, and a sleep interval.

The power efficient and delay aware medium access control for sensor networks (PEDAMACS) protocol represents a wireless sensor network communication method targeting a safe drive support service on the road. The PEDAMACS prevents communication collisions between a plurality of sensor nodes through the time division multiple access (TDMA) method in advance, and guarantees data arrival within a defined time data to minimize data transmission failure.

The wireless sensor network is also used as an infrastructure for a telematics service such as the safe drive support service, and it must support real-time data transmission and safe data transmission for the usage. However, the actual road environment frequently generates communication errors of the sensor node because of frequent traffic. Particularly, when a vehicle is located on a sensor node, the communication errors of the sensor node steeply increase. Such generation of communication errors causes the sensor node to retransmit data and thereby increase a communication delay time and reduce communication reliability. The communication methods of the above-described wireless sensor network have been designed without considering the communication errors caused by the vehicles, and it is difficult for them to perform safe data transmission on a real road.

Therefore, a method for allowing safe communication by minimizing generation of communication errors at the sensor node caused by obstacles such as vehicles on the road is required.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a communication method and device for minimizing generation of communication errors of the sensor network and providing safe communication on the road.

An exemplary embodiment of the present invention provides a sensor node included in a sensor network in the road environment, including: a sensor for outputting sensing information generated by sensing an obstacle interrupting communication of the sensor node; an obstacle determiner for determining existence of an obstacle based on the sensing information; and a controller for determining a wakeup zone of data transmitted by the sensor node based on the existence state of the obstacle.

Another embodiment of the present invention provides a communication method of a sensor node included in a sensor network in a road environment, including: acquiring sensing information generated by sensing the existence state of an obstacle interrupting communication of the sensor node; selecting a wakeup zone of data transmitted by the sensor node from among a sink node included in the sensor network and at least one sensor node based on the sensing information; and transmitting a transmission frame into which a flag bit corresponding to the wakeup zone is inserted.

Yet another embodiment of the present invention provides a communication method of a sensor node included in a sensor network in the road environment, including: receiving wakeup zone configuration information for each sensor node included in the sensor network from a sink node included in the sensor network when switching to a receive mode; receiving a wakeup zone of a transmit node from the transmit node corresponding to wakeup zone configuration information including the sensor node from among the wakeup zone configuration information for each sensor node; and waking up so as to receive data of the transmit node when the sensor node is included in the wakeup zone.

DETAILED DESCRIPTION OF THE EMBODIMENTS

Figure 1:
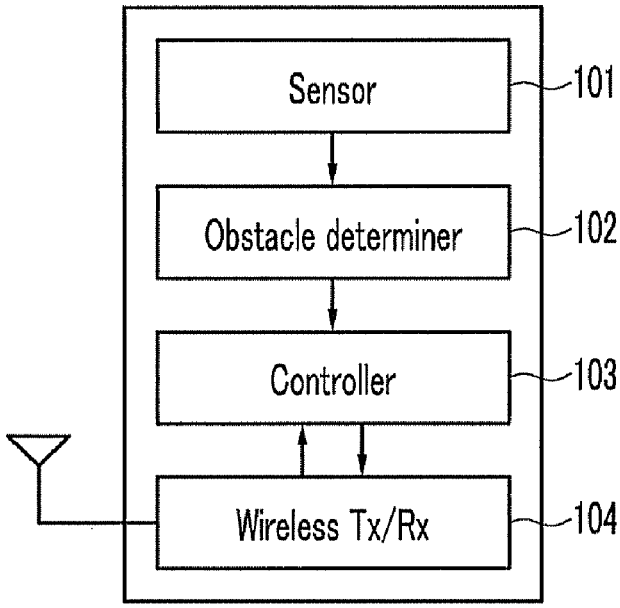
FIG. 1 shows a configuration diagram of a sensor node according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout the specification, unless explicitly described to the contrary, the word "comprise" and variations such as "comprises" or "comprising" will be understood to imply the inclusion of stated elements but not the exclusion of any other elements.

An adaptive communication method on the road and a sensor node for performing the method according to an exemplary embodiment of the present invention will now be described with reference to accompanying drawings.

A sensor network under the road environment according to an exemplary embodiment of the present invention includes several sink nodes and a plurality of sensor nodes, and each sensor node is operable as a transmit node or a receive node.

FIG. 1 shows a configuration diagram of a sensor node according to an exemplary embodiment of the present invention.

Referring to FIG. 1, the sensor node includes a sensor 101, an obstacle determiner 102, a controller 103, and a wireless transmitter/receiver 104.

The sensor 101 includes a magnetic sensor and a pressure sensor, and it outputs sensing information generated by sensing whether there is a vehicle interrupting the corresponding sensor node's communication. That is, the magnetic sensor outputs sensing information generated by sensing whether there is a vehicle occupying the corresponding sensor node, and the pressure sensor outputs sensing information generated by sensing whether there is a vehicle located on the corresponding sensor node. Here, a case that a body of a vehicle is located within a sensing range of a sensor node may be considered as the vehicle occupies the sensor node. Also, a case that a wheel of a vehicle is located on a sensor node may be considered as the vehicle is located on the sensor node.

The exemplary embodiment of the present invention describes the case in which the obstacle occupying or located on the sensor node is a vehicle, and other types of vehicles are applicable to the present invention. Also, the exemplary embodiment of the present invention shows the case in which a magnetic sensor and a pressure sensor are used to sense whether an obstacle occupies the sensor node, and it is possible in the present invention to sense the obstacle's sensor node occupation by using other types of sensors.

The obstacle determiner 102 determines whether there is an obstacle interrupting the corresponding sensor node's communication based on sensing information output by the sensor 101, and outputs a result.

The controller 103 controls switching of modes (transmit mode, receive mode, and idle mode) by the corresponding sensor node. Also, the controller 103 adaptively determines the communication method based on the received signal strength indication (RSSI) of a control packet received from the sink node through the wireless transmitter/receiver 104 and the output by the obstacle determiner 102, and controls the wireless transmitter/receiver 104 based on the adaptive determination. That is, the controller 103 determines output strength of a transmitted signal in the case in which the corresponding sensor node is operated as the transmit node, and it determines a wakeup zone of the data transmitted by the corresponding sensor node. The output strength of a transmitted signal is called "transmitted signal output strength".

The controller 103 generates a transmission frame by inserting a flag bit corresponding to the wakeup zone after a preamble. The flag bit corresponding to the wakeup zone will be referred to as a "wakeup zone flag."

In addition, the controller 103 determines whether the corresponding sensor node has to wake up so as to receive the data transmitted by the transmit node based on wakeup zone configuration information received from the sink node through the wireless transmitter/receiver 104 and the wakeup zone flag received from another sensor node that is operable as a transmit node when the corresponding sensor node is operated as a receive mode, and controls the wireless transmitter/receiver 104 based on the determination.

Figure 2:
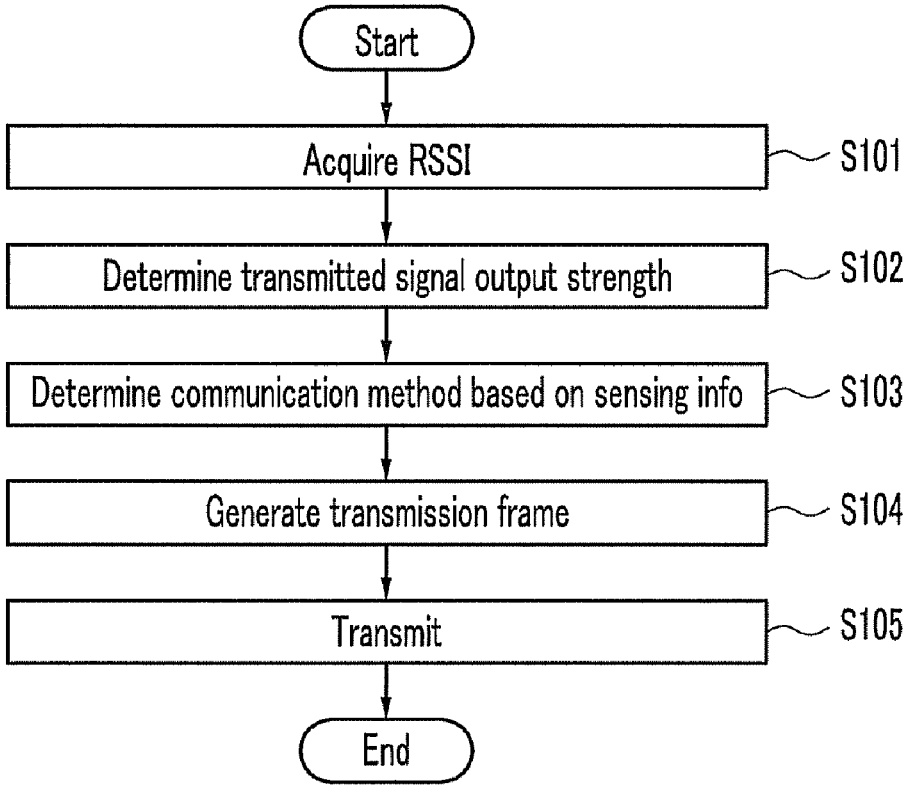
FIG. 2 shows a flowchart of a method for a sensor node to transmit data according to an exemplary embodiment of the present invention.
Figure 3:
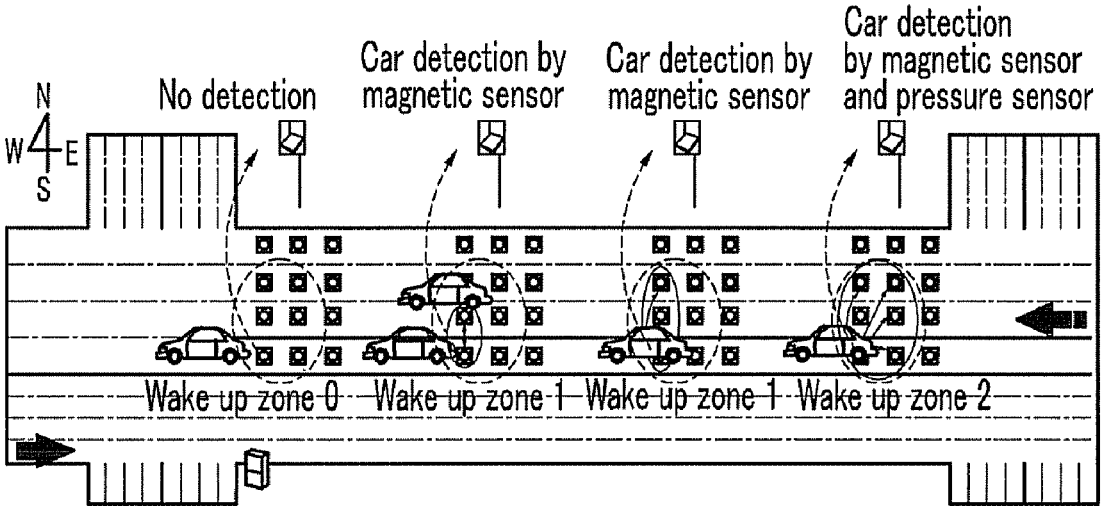
FIG. 3 shows a case for adaptively determining a communication method in a road environment according to an exemplary embodiment of the present invention.

FIG. 2 shows a flowchart of a method for a sensor node to transmit data according to an exemplary embodiment of the present invention, and FIG. 3 shows a case for adaptively determining a communication method in a road environment according to an exemplary embodiment of the present invention.

Referring to FIG. 2, the sensor node periodically receives RSSI of the control packet from the sink node (S101), and determines whether there is an obstacle on the line of sight (LOS) between the corresponding sensor node and the sink node based on the RSSI information.

The sensor node determines the transmitted signal output strength as expressed in Equation 1 (S102).

$$\begin{aligned} &\text{RSSI} < R_thr(l) \text{->transmit packet } Pr(L) \\ &R_thr(l) \leqq \text{RSSI} \leqq R_thr(s) \text{->transmit packet } Pr(M) \\ &R_thr(s) < \text{RSSI->transmit packet } Pr(S) \end{aligned} \qquad \text{(Equation 1)}$$

R_thr(l): RSSI Threshold for high-tx power
R_thr(s): RSSI Threshold for low-tx power
Pr(L): high-tx power
Pr(M): middle-tx power
Pr(S): low-tx power In Equation 1, when the RSSI is less than a first threshold value R_thr(l) (i.e., RSSI<R_thr(l)), the sensor node selects the highest first strength Pr(L) as the transmitted signal output strength. When the RSSI is greater than a second threshold value R_thr(s) (i.e., R_thr(s)<RSSI), the sensor node selects the lowest second strength Pr(S) as the transmitted signal output strength. Further, when the RSSI is greater than the first threshold value and less than the second threshold value (i.e., R_thr(l)≦RSSI≦R_thr(s)), the sensor node selects a third strength Pr(M) between the first strength and the second strength as the transmitted signal output strength.

When the transmitted signal output strength is determined based on the RSSI as described above, the sensor node determines the communication method based on the sensing information acquired from the magnetic sensor and the pressure sensor of the sensor 101 (S103). That is, the wakeup zone of the data transmitted by the corresponding sensor node is determined by detecting whether there is an occupying vehicle and whether there is a vehicle located on the corresponding sensor node.

Referring to FIG. 3, as an example, the sensor node at which no occupying vehicle is sensed determines the communication channel to be good, and selects a first range (i.e., wakeup zone 0) including a sink node as the wakeup zone. On the other hand, the sensor node at which an occupying vehicle is sensed, that is, the sensor node having sensed the vehicle through the magnetic sensor, selects a second range (i.e., wakeup zone 1) including a sink node and n different sensor nodes as the wakeup zone. Also, the sensor node at which an occupying vehicle and a vehicle located on the corresponding sensor node are sensed, that is, the sensor node having sensed the vehicle through the magnetic sensor and the pressure sensor, selects a third range (i.e., wakeup zone 2) including a sink node and (n+m) different sensor nodes as the wakeup zone.

When the communication method is determined as described above, the sensor node generates a transmission frame into which the communication method selected by the sensor node, that is, a wakeup zone flag corresponding to the selected wakeup zone (S104), and transmits the generated transmission frame when it becomes the transmit mode (S105).

The exemplary embodiment of the present invention describes the case in which the sensor node selects one of the three wakeup zones 0 to 2 as the wakeup zone of the sensor node based on the sensing information acquired through the sensor 101, and it is also possible in the present invention to select the wakeup zone by using the RSSI together with the sensing information. In this case, the number of wakeup zones can be increased or reduced.

For example, when an occupying vehicle is not sensed and the RSSI is greater than the second threshold value, the communication channel state is determined to be excellent to select the wakeup zone including the sink node, and when an occupying vehicle is sensed and the RSSI is between the first threshold value and the second threshold value, the communication channel state is determined to be good to select the wakeup zone including the sink node and l sensor nodes. Also, when an occupying vehicle is sensed and the RSSI is less than the first threshold value, the communication channel state is determined to be poor to select the wakeup zone including the sink node and the (l+n) sensor nodes, and when an occupying vehicle and another vehicle located on the sensor node are sensed and the RSSI is less than the first threshold value, it is possible to select the wakeup zone including the sink node and the (l+n+m) sensor nodes.

Figure 4:
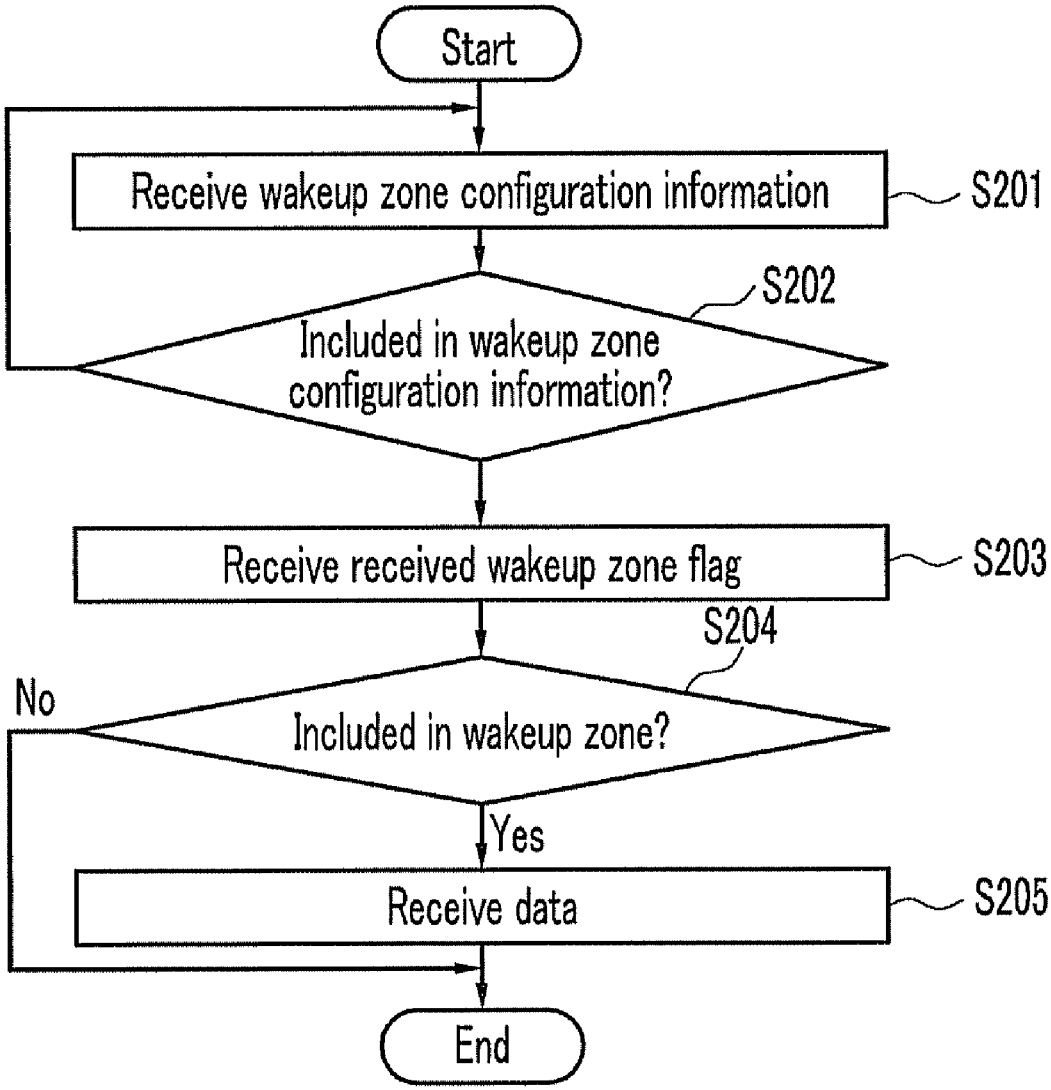
FIG. 4 shows a flowchart of a method for a sensor node to receive data according to an exemplary embodiment of the present invention.

FIG. 4 shows a flowchart of a method for a sensor node to receive data according to an exemplary embodiment of the present invention.

Referring to FIG. 4, the sensor node switched to the receive mode receives wakeup zone configuration information included in the sensor network from the sink node (S201). Here, the wakeup zone configuration information includes types of wakeup zones that are selectable when the corresponding sensor node is operable as a transmit node for each sensor node, and identity information of the sensor node for each wakeup zone. In this instance, the sink node uses a data transmission success rate of the sensor node in order to configure wakeup zone configuration information for each sensor node. That is, the wakeup zone configuration information is generated by increasing the number of sensor nodes included in the wakeup zone when the data transmission success rate is low, and by reducing the number of sensor nodes included in the wakeup zone when the same is high. The data transmission success rate of each sensor node can be expressed as Equation 2.

Data transmission success rate=(number of transmission trials−number of successfully transmitted packets)/number of transmission trials (Equation 2)

Here, the number of transmission trials on the sensor node is acquirable through a sequence number included in the data packet transmitted by the corresponding sensor node, and the number of successfully transmitted packets represents the number of packets successfully received by the actual sink node from the corresponding sensor node.

The sensor node having received the above-configured wakeup zone configuration information for each sensor node checks whether the wakeup zone configuration information includes the sensor node (S202), and checks the sensor node corresponding to the wakeup zone configuration information including the sensor node. When being included in the wakeup zone configuration information, the sensor node checks whether the current transmit node is a transmit node corresponding to the wakeup zone configuration information where the sensor node belongs, and when it corresponds to the wakeup zone configuration information where the sensor node belongs, the sensor node receives a wakeup zone flag from the corresponding transmit node (S203). The sensor node checks whether the sensor node is included in the wakeup zone selected by the transmit node through the wakeup zone flag (S204).

When the sensor node is included in the wakeup zone selected by the transmit node according to the checking result, the sensor node wakes and receives the data from the transmit node (S205).

According to the embodiments of the present invention, it is detected in real-time whether communication of the sensor node is obstructed by the obstacles such as vehicles and the communication method is adaptively changed to thus reduce the communication errors and increase the communication success rate, and it is possible for a sensor node other than a transmit node to wake up and actively determine whether to receive for each transmission interval, thereby reducing wakeup time and power consumption.

The above-described embodiments can be realized through a program for realizing functions corresponding to the configuration of the embodiments or a recording medium for recording the program in addition to through the above-described device and/or method, which is easily realized by a person skilled in the art.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A sensor node included in a sensor network in a road environment, comprising:

a sensor for outputting sensing information generated by sensing an obstacle interrupting communication of the sensor node;

an obstacle determiner for determining existence of an obstacle based on the sensing information; and a controller for determining a wakeup zone of data transmitted by the sensor node based on the existence state of the obstacle.

2. The sensor node of claim 1, wherein the sensor includes:

a first sensor for sensing whether there is an obstacle occupying the sensor node; and a second sensor for sensing whether there is an obstacle located on the sensor node.

3. The sensor node of claim 1, wherein the controller determines transmitted signal output strength based on a received signal strength indication of a control packet received from a sink node included in the sensor network.

4. The sensor node of claim 3, wherein the controller determines the wakeup zone including the sink node and at least one of a plurality of sensor nodes based on the received signal strength indication and the existence state of the obstacle.

5. The sensor node of claim 4, wherein the controller inserts a flag bit corresponding to the wakeup zone after a preamble of a transmission frame, and transmits the same.

6. The sensor node of claim 5, wherein the controller determines whether to receive data of a transmit node based on wakeup zone configuration information for each sensor node received from the sink node and a wakeup zone of the transmit node received from the transmit node during an operation in the receive mode.

7. A communication method of a sensor node included in a sensor network in a road environment, comprising:

acquiring sensing information generated by sensing the existence state of an obstacle interrupting communication of the sensor node;

selecting a wakeup zone of data transmitted by the sensor node from among a sink node included in the sensor network and at least one sensor node based on the sensing information; and transmitting a transmission frame into which a flag bit corresponding to the wakeup zone is inserted.

8. The communication method of claim 7, wherein the communication method includes:

acquiring a received signal strength indication from a control packet received from the sink node; and determining transmitted signal output strength based on the received signal strength indication.

9. The communication method of claim 8, wherein the selecting includes selecting the wakeup zone based on the received signal strength indication and the sensing information.

10. The communication method of claim 7, wherein the sensing information includes information generated by sensing an obstacle occupying the sensor node and information generated by sensing an obstacle located on the sensor node.

11. A communication method of a sensor node included in a sensor network in the road environment, comprising:

receiving wakeup zone configuration information for each sensor node included in the sensor network from a sink node included in the sensor network when switched to a receive mode;

receiving a wakeup zone of a transmit node from the transmit node corresponding to wakeup zone configuration information including the sensor node from among the wakeup zone configuration information for each sensor node; and waking up so as to receive data of the transmit node when the sensor node is included in the wakeup zone.

12. The communication method of claim 11, wherein the sink node selects a number of sensor nodes included in wakeup zone configuration information for each sensor node based on a data transmission success rate for each sensor node included in the sensor network.

13. The communication method of claim 12, wherein the wakeup zone configuration information includes types of wakeup zones that are selectable when the sensor node is operable as a transmit node and identity information of a sensor node included for each wakeup zone.

14. The communication method of claim 12, wherein the wakeup zone is acquired from a flag bit transmitted after a preamble of a transmission frame received from the transmit node.

* * * * *